US009466410B2

(12) United States Patent
Huang et al.

(10) Patent No.: US 9,466,410 B2
(45) Date of Patent: Oct. 11, 2016

(54) SLIDE-TYPE VARIABLE RESISTOR

(71) Applicant: Yu-Chen Chuang, Taoyuan County (TW)

(72) Inventors: Tzu-Hsuan Huang, Taoyuan County (TW); Wei-Liang Liu, Taoyuan County (TW); Chien-Chih Ho, Taoyuan County (TW)

(73) Assignee: Taiwan Alpha Electronic Co., Ltd., Taoyuan (TW)

( * ) Notice: Subject to any disclaimer, the term of this patent is extended or adjusted under 35 U.S.C. 154(b) by 124 days.

(21) Appl. No.: 14/629,825

(22) Filed: Feb. 24, 2015

(65) Prior Publication Data

US 2016/0125984 A1 May 5, 2016

(30) Foreign Application Priority Data

Oct. 31, 2014 (TW) ..... 103219328 U

(51) Int. Cl.
*H01C 10/44* (2006.01)
*H01C 1/014* (2006.01)
*H01C 1/02* (2006.01)

(52) U.S. Cl.
CPC ..... *H01C 10/44* (2013.01); *H01C 1/014* (2013.01); *H01C 1/02* (2013.01)

(58) Field of Classification Search
CPC ..... H01C 10/44; H01C 1/014; H01C 1/02
USPC ..... 338/183, 176, 160
See application file for complete search history.

(56) References Cited

U.S. PATENT DOCUMENTS 3,609,623 A * 9/1971 Zdanys, Jr. ..... H01C 10/44 338/125
3,693,129 A * 9/1972 Shimizu ..... H01C 10/44 338/183
4,047,146 A * 9/1977 Takeyama ..... H01C 10/44 200/304
5,673,015 A * 9/1997 Imamura ..... H01C 10/38 338/118
5,825,279 A * 10/1998 Yagi ..... H01C 10/44 338/118
7,710,237 B2 * 5/2010 Kato ..... H01C 10/14 200/252

* cited by examiner

*Primary Examiner* — Kyung Lee
(74) *Attorney, Agent, or Firm* — Rosenberg, Klein & Lee

(57) ABSTRACT

A slide-type variable resistor comprises a shell, two side guiding tracks, two end locking parts, a variable resistor circuit base, and a manipulating device. The two side guiding tracks are symmetrically assembled in the allocation space. The two end locking parts are symmetrically pressing against the two side guiding tracks respectively to have the two side guiding tracks positioned in the allocation space. The variable resistor circuit base is assembled to the shell and utilized for pressing against the two end locking parts to have the two end locking parts and the two side guiding tracks fixed in the allocation space. The manipulating device comprises a brush base, at least a brush, and a bar. The brush base has two symmetrically positioned sliding tracks slidably positioned in the two side guiding tracks. The brush is connected to the brush base and has elastic recovery to press against the variable resistor circuit base. The bar is connected to the brush base and extended outward from the position restriction hole of the shell.

4 Claims, 3 Drawing Sheets

SLIDE-TYPE VARIABLE RESISTOR

FIELD OF THE INVENTION

The present invention is related to a slide-type variable resistor, and more particularly related to a slide-type variable resistor with two side guiding tracks for guiding a brush base when doing the sliding operation.

BACKGROUND OF THE INVENTION

It is common in our daily life to adjust the value of an output voltage signals by using a manipulating device, such as the variable resistor. Based on the type of operation, the variable resistors can be sorted as rotating-type variable resistors and slide-type variable resistors.

FIG. 1 is an explosive view of a conventional slide-type variable resistor. As shown, the variable resistor PA100 includes a shell PA1, two fixing parts PA2, two guiding rods PA3, a brush base PA4, and a circuit base PA5. Each of the two fixing parts PA2 has tow positioning grooves PA21. The brush base PA4 has a main body PA41, two brushes PA42, and a manipulating part PA43. The two sliding rods PA3 penetrate two through holes PA411 of the main body PA41 respectively and located in the positioning grooves PA21 of the two fixing parts PA2. Then, the brush base PA4 together with the two sliding rods PA3 and the two fixing parts PA2 are positioned in the shell PA1 with the manipulating part PA43 extending outward from the position restriction hole of the shell PA1 such that the user can operate the manipulating part PA43 to control the position the brushes PA42 to contact the resistance circuit on the circuit base PA5 so as to generate different output voltage.

As mentioned, because the brush base PA4 is designed to move along the sliding rods PA3, which are merely supported by the fixing parts PA2 at the opposite ends of the sliding rod PA3, the sliding rods PA3 might be easily escaped from the positioning groove PA21 due to improper operation which may damage the variable resistor PA100 or make the variable resistor PA100 inoperative.

BRIEF SUMMARY OF INVENTION

As mentioned, the variable resistors nowadays rely on the two positioning grooves at the opposite sides of the sliding rod to support the hanged sliding rod, such that the sliding rods might be easily escaped from the positioning grooves to make the variable resistor inoperative due to the improper operation of the user.

Accordingly, it is an object of the present invention to provide a slide-type variable resistor, which has the brush base slidably assembled to the two side guiding tracks and uses two end locking parts to fix the two side guiding tracks in the shell.

As mentioned, a slide-type variable resistor is provided in accordance with an embodiment of the present invention. The slide-type variable resistor comprises a shell, two side guiding tracks, two end locking parts, a variable resistor circuit base, and a manipulating device. The shell has a position restriction hole extending along an operation direction and an allocation space linked to the position restriction hole formed therein. The two side guiding tracks are extending along the operation direction and symmetrically assembled in the allocation space. The two end locking parts are symmetrically assembled in the allocation space and utilized for pressing against the two side guiding tracks respectively to have the two side guiding tracks and the two end locking parts constrained in the allocation space. The variable resistor circuit base is assembled to the shell and utilized for pressing against the two end locking parts to have the two end locking parts and the two side guiding tracks fixed in the allocation space. The manipulating device comprises a brush base, at least a brush, and a bar. The brush base is slidably positioned in the two side guiding tracks. The brush is connected to the brush base and has elastic recovery to press against the variable resistor circuit base. The bar is connected to the brush base and extended outward from the position restriction hole.

As mentioned, by using the two end locking parts pressing against the two side guiding tracks and the variable resistor circuit base, the two side guiding tracks can be firmly positioned in the allocation space to have the sliding operation of the brush base more stable.

In accordance with an embodiment of the present invention, the shell comprises a top portion, two side portions, and two end portions. The top portion has the position restriction hole. The two side portions are integrally connected to two sides of the top portion. The two end portions are integrally connected to two ends of the top portion and contact the two side portion. The allocation space linked to the position restriction hole is defined by the top portion, the two side portions and the two end portions. As a preferred embodiment, the two end locking parts further press against the two end portions. In addition, each of the two side portion has at least a mounting structure, which is bended to lock the variable resistor circuit base.

The embodiments adopted in the present invention would be further discussed by using the flowing paragraph and the figures for a better understanding.

DETAILED DESCRIPTION OF THE INVENTION

Figure 1:
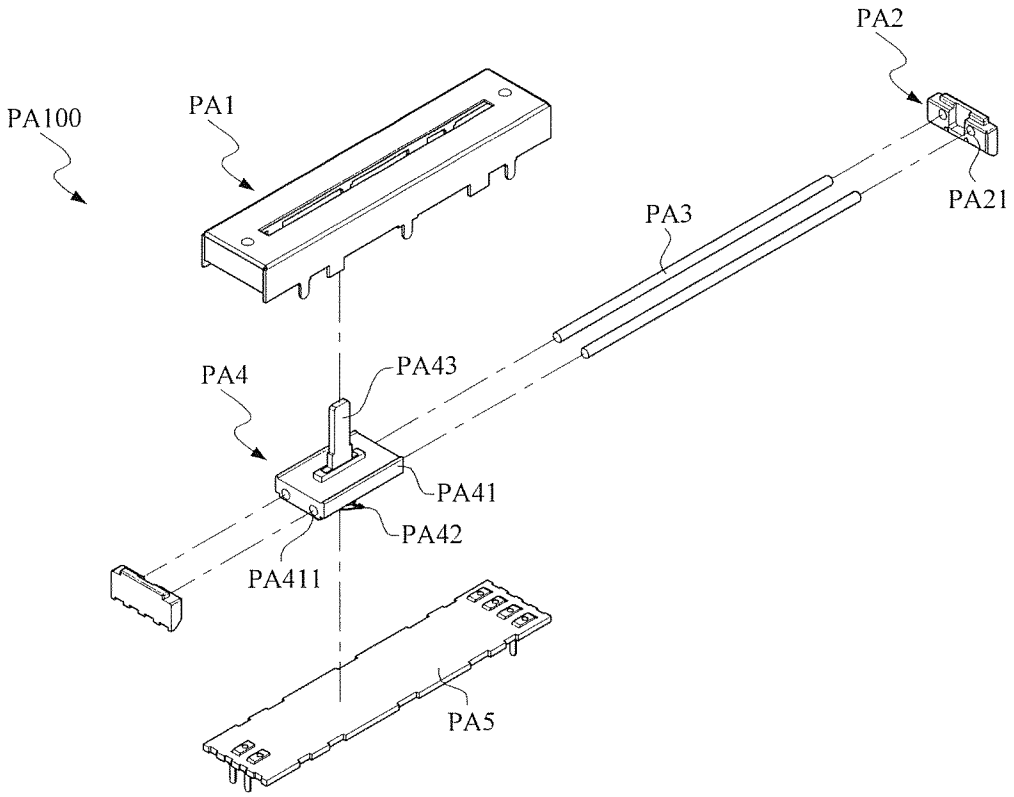
FIG.1(Prior Art)
FIG. 1 is an explosive view of a conventional slide-type variable resistor.
Figure 2:
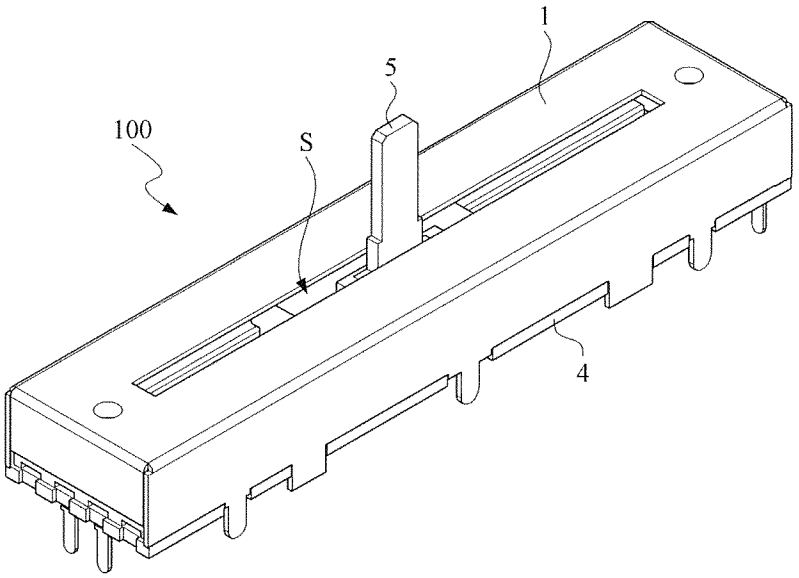
FIG. 2 is a 3D schematic view of a slide-type variable resistor in accordance with a preferred embodiment of the present invention.
Figure 3:
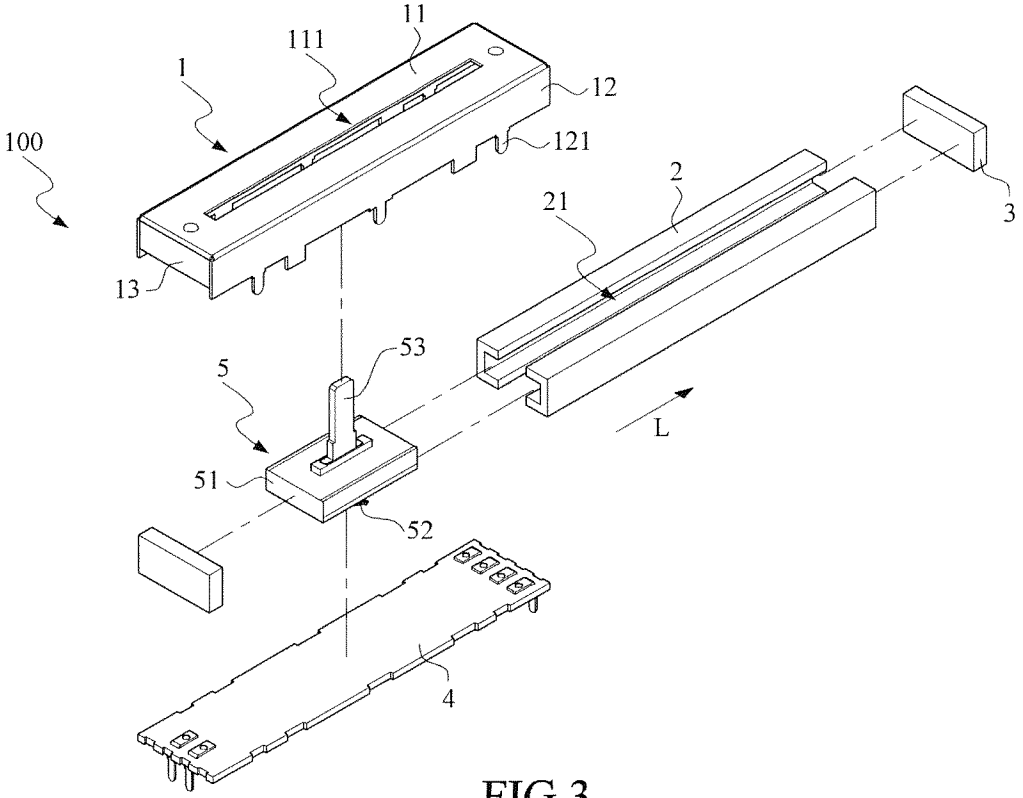
FIG. 3 is an explosive view of a slide-type variable resistor in accordance with a preferred embodiment of the present invention.

Please refer to FIG. 2 and FIG. 3, wherein FIG. 2 is a 3D schematic view of a slide-type variable resistor in accordance with a preferred embodiment of the present invention and FIG. 3 is an explosive view of a slide-type variable resistor in accordance with a preferred embodiment of the present invention.

As shown, the slide-type variable resistor 100 includes a shell 1, two side guiding tracks 2, two end locking parts 3, a variable resistance circuit board 4, and a manipulating device 5.

The shell 1 includes a top portion 11, two side portions 12 (only one of them is labeled), and two end portions 13 (only one of them is labeled). The top portion 11 has a position restriction hole 111, which extends along an operation direction L.

The two side portions 12 are integrally connected to two sides of the top portion 11, and each of the two side portions 12 has three mounting structures 121 (only one of them is labeled). The two end portions 13 are integrally connected to two ends of the top portion 11 and contact the two side portions 12 such that an allocation space S encircled by the top portion 11, the two side portions 12 and the two end portions 13 is formed and the allocation space S is linked to the position restriction hole 111.

The two side guiding tracks 2 are extended along the operation direction L and symmetrically positioned in the allocation space S. Each of the side guiding tracks 2 has a sliding trench 21.

The two end locking parts 3 are symmetrically positioned in the allocation space S and press against the two side guiding tracks 2 and the two end portions 13 respectively so as to have the two side guiding tracks 2 and the two end locking parts 3 constrained in the allocation space S.

The variable resistor circuit base 4 is locked by bending the mounting structures 121 on the side portion 12 of the shell 1 so as to have the variable resistor circuit base 4 connected to the shell 1 and press against the two end locking parts 3 and the two side guiding tracks 2 within the allocation space S to have the two side fixing parts 3 and the two side guiding tracks 2 fixed in the allocation space S. In addition, the shell 1 may be fixed to the variable resistor circuit base 4 by the way other than bending the mounting structures provided in the present embodiment. For example, elastic locking units may be used to fix the shell on the variable resistor circuit base.

The manipulation device 5 includes a brush base 51, two symmetrically positioned brushes 52 (only one of them is shown in the figure), and a bar 53. The opposite sides of the brush base 51 are slidably positioned in the sliding trenches 21 of the two side guiding tracks 2. The brushes 52 are connected and fixed to the brush base 51 and with elasticity to press against the variable resistor circuit base 4. The bar 53 is connected to the brush base 51 and penetrates outward from the position restriction hole 111.

As mentioned, in accordance with the present invention, the two end locking parts press against the two side guiding tracks 2 and the two end portions 13, and the variable resistor circuit base 4 presses against the two side guiding tracks 2 and the two end locking parts 3 such that the two side guiding tracks 2 can be firmly positioned in the allocation space S.

When the user operates the manipulation device 5 to slide the brush base 51, because the two side guiding tracks 2 are closely positioned by the two side portions 12 respectively, and the two end locking parts 3 are also closely positioned by the two end portions 13 respectively, the fixing mechanism of the two side guiding tracks 2 and the two end locking parts 3 would be quite stable to withstand the improper operation.

In addition, the two side guiding tracks may be integrally connected to the two side portions of the shell respectively in accordance with another embodiment of the present invention. That is, the two side portions of the shell may be formed with the shape of the side guiding tracks corresponding to the sliding tracks of the brush base.

The detail description of the aforementioned preferred embodiments is for clarifying the feature and the spirit of the present invention. The present invention should not be limited by any of the exemplary embodiments described herein, but should be defined only in accordance with the following claims and their equivalents. Specifically, those skilled in the art should appreciate that they can readily use the disclosed conception and specific embodiments as a basis for designing or modifying other structures for carrying out the same purposes of the present invention without departing from the scope of the invention as defined by the appended claims.

We claim:

1. A slide-type variable resistor, comprising:

a shell, having a position restriction hole extending along an operation direction and an allocation space linked to the position restriction hole formed therein;

two side guiding tracks, extending along the operation direction and symmetrically assembled in the allocation space;

two end locking parts, symmetrically assembled in the allocation space and pressing against the two side guiding tracks respectively to have the two side guiding tracks and the two end locking parts constrained in the allocation space:

a variable resistor circuit base, assembled to the shell and pressing against the two end locking parts to have the two end locking parts and the two side guiding tracks fixed in the allocation space; and a manipulating device, comprising:

a brush base, slidably positioned in the two side guiding tracks;

at least a brush, connected to the brush base, and with elastic recovery to press against the variable resistor circuit base; and a bar, connected to the brush base and extended outward from the position restriction hole.

2. The slide-type variable resistor of claim 1, wherein the shell comprises:

a top portion, having the position restriction hole;

two side portions, integrally connected to two sides of the top portion; and two end portions, integrally connected to two ends of the top portion, and contacting the two side portion, wherein the allocation space linked to the position restriction hole is defined by the top portion, the two side portions and the two end portions.

3. The slide-type variable resistor of claim 2, wherein the two end locking parts further press against the two end portions.

4. The slide-type variable resistor of claim 2, wherein each of the two side portion has at least a mounting structure, which is bended to lock the variable resistor circuit base.

* * * * *